US009188299B2

(12) United States Patent
Fiederling et al.

(10) Patent No.: US 9,188,299 B2
(45) Date of Patent: Nov. 17, 2015

(54) LIGHTING DEVICE

(71) Applicant: OSRAM GmbH, Munich (DE)

(72) Inventors: Roland Fiederling, Friedberg (DE); Philipp Helbig, Heidenheim (DE); Thomas Feil, Gschwend (DE)

(73) Assignee: OSRAM GmbH, Munich (DE)

( * ) Notice: Subject to any disclaimer, the term of this patent is extended or adjusted under 35 U.S.C. 154(b) by 1 day.

(21) Appl. No.: 14/074,875

(22) Filed: Nov. 8, 2013

(65) Prior Publication Data

US 2014/0133168 A1 May 15, 2014

(30) Foreign Application Priority Data

Nov. 9, 2012 (DE) ..... 10 2012 220 457

(51) Int. Cl.
*F21V 9/00* (2015.01)
*F21S 8/10* (2006.01)

(52) U.S. Cl.
CPC ..... *F21S 48/1241* (2013.01); *F21S 48/1154* (2013.01)

(58) Field of Classification Search
CPC ..... F21S 48/1241
USPC ..... 362/511
See application file for complete search history.

(56) References Cited

U.S. PATENT DOCUMENTS 4,733,335 A * 3/1988 Serizawa et al. ..... 362/503
7,581,860 B2 9/2009 Bogner et al.
2006/0250814 A1 11/2006 Tabor
2008/0013333 A1 1/2008 Koizumi et al.
2011/0122617 A1 5/2011 Frey et al.

FOREIGN PATENT DOCUMENTS

DE 10036323 A1 2/2002
DE 10231326 A1 2/2004
DE 102006002322 A1 12/2007

(Continued)

OTHER PUBLICATIONS

English abstract of DE 102009053581 B3 of Mar. 3, 2011.
English abstract of DE10036323 A1 of Feb. 7, 2002.
English abstract of DE 10231326 A1 of Feb. 19, 2004.
English abstract of DE 102006002322 A1 of Dec. 27, 2007.

(Continued)

*Primary Examiner* — Anh Mai
*Assistant Examiner* — Hana Featherly

(57) ABSTRACT

A lighting device may include: a plurality of light sources; and a plurality of waveguides; wherein the waveguides each have a light coupling-in surface and a light coupling-out surface; wherein the light coupling-in surfaces are respectively assigned a light-emitting surface of a light source, such that light emitted by the light-emitting surface of the light source impinges on the light coupling-in surface of the waveguide assigned thereto; wherein the light coupling-out surfaces of the waveguides are arranged in a matrix-like manner; wherein the light coupling-in surface of the respective waveguide is smaller than the light-emitting surface of the light source assigned to said waveguide, and a grating-like optical diaphragm having grating cells is provided, which is arranged in the region of the light coupling-in surfaces of the waveguides, such that light coupling-in surfaces belonging to different waveguides are arranged in different grating cells of the grating-like optical diaphragm.

13 Claims, 6 Drawing Sheets

(56) References Cited

FOREIGN PATENT DOCUMENTS

| | | | |
|---|---|---|---|
| DE | 102008033416 | A1 | 1/2010 |
| DE | 102009053581 | B3 | 3/2011 |
| EP | 1842723 | B1 | 2/2009 |
| EP | 2280215 | A2 | 2/2011 |
| JP | 2008026854 | A | 2/2008 |

OTHER PUBLICATIONS

English abstract of EP 2280215 A2 of Feb. 2, 2011.
English abstract of JP 2008026854 A of Feb. 7, 2008.
Search Report issued in the corresponding German application No. 102012220457.1 dated Jul. 3, 2013.

* cited by examiner

LIGHTING DEVICE

CROSS-REFERENCE TO RELATED APPLICATION

This application claims priority to German Patent Application Serial No. 10 2012 220 457, which was filed Nov. 9, 2012, and is incorporated herein by reference in its entirety.

TECHNICAL FIELD

Various embodiments relate to a lighting device.

BACKGROUND

A lighting device of this type is disclosed in EP 1 842 723 B1, for example. Said document describes a lighting device for a vehicle headlight which has a plurality of semiconductor light sources arranged in a matrix-like fashion and a plurality of optical waveguides assigned to the semiconductor light sources.

SUMMARY

A lighting device may include: a plurality of light sources; and a plurality of waveguides; wherein the waveguides each have a light coupling-in surface and a light coupling-out surface; wherein the light coupling-in surfaces are respectively assigned a light-emitting surface of a light source, such that light emitted by the light-emitting surface of the light source impinges on the light coupling-in surface of the waveguide assigned thereto; wherein the light coupling-out surfaces of the waveguides are arranged in a matrix-like manner; wherein the light coupling-in surface of the respective waveguide is smaller than the light-emitting surface of the light source assigned to said waveguide, and a grating-like optical diaphragm having grating cells is provided, which is arranged in the region of the light coupling-in surfaces of the waveguides, such that light coupling-in surfaces belonging to different waveguides are arranged in different grating cells of the grating-like optical diaphragm.

BRIEF DESCRIPTION OF THE DRAWINGS

In the drawings, like reference characters generally refer to the same parts throughout the different views. The drawings are not necessarily to scale, emphasis instead generally being placed upon illustrating the principles of the invention. In the following description, various embodiments of the invention are described with reference to the following drawings, in which.

DESCRIPTION

Figure 1:
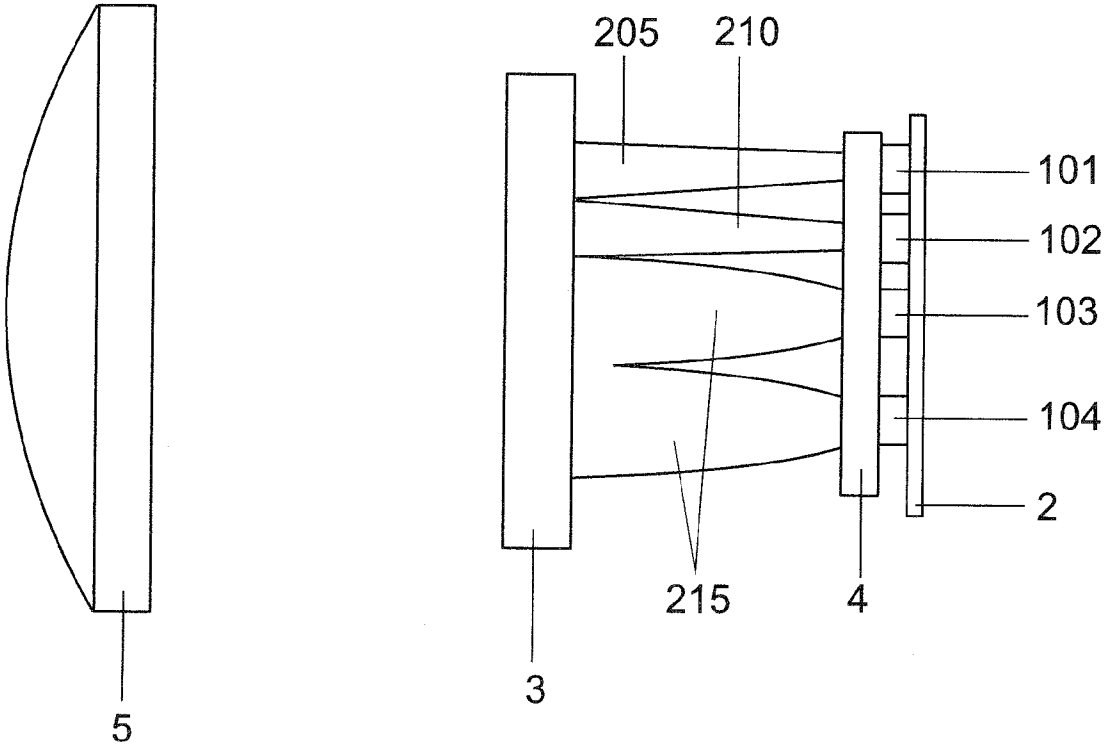
FIG. 1 shows a schematic illustration of the construction of the lighting device in accordance with various embodiments.

The following detailed description refers to the accompanying drawings that show, by way of illustration, specific details and embodiments in which the invention may be practiced.

The word "exemplary" is used herein to mean "serving as an example, instance, or illustration". Any embodiment or design described herein as "exemplary" is not necessarily to be construed as preferred or advantageous over other embodiments or designs.

The word "over" used with regards to a deposited material formed "over" a side or surface, may be used herein to mean that the deposited material may be formed "directly on", e.g. in direct contact with, the implied side or surface. The word "over" used with regards to a deposited material formed "over" a side or surface, may be used herein to mean that the deposited material may be formed "indirectly on" the implied side or surface with one or more additional layers being arranged between the implied side or surface and the deposited material.

Various embodiments provide a lighting device which is suitable for use in a vehicle headlight and which makes it possible to adapt the light distribution to different functions, such as, for example, low-beam light and high-beam light, etc., and ensures the formation of a sharply delineated bright-dark boundary between illuminated and non-illuminated regions in front of the motor vehicle.

The lighting device according to various embodiments includes a plurality of semiconductor light sources and a plurality of optical waveguides, wherein the optical waveguides each have at least one light coupling-in surface and a light coupling-out surface, and the light coupling-in surfaces of the optical waveguides are respectively assigned a light-emitting surface of at least one semiconductor light source, such that light emitted by the at least one semiconductor light source impinges on the light coupling-in surface of the optical waveguide assigned thereto, and wherein the light coupling-out surfaces of the optical waveguides are arranged in a matrix-like manner. According to various embodiments, the light coupling-in surface of the respective optical waveguide is smaller than the light-emitting surface of the at least one semiconductor light source assigned to said optical waveguide. In addition, according to various embodiments, a grating-like optical diaphragm having grating cells is provided, which is arranged in the region of the light coupling-in surfaces of the optical waveguides, such that light coupling-in surfaces belonging to different optical waveguides are arranged in different grating cells of the grating-like optical diaphragm.

This ensures that with the aid of the lighting device according to various embodiments, when used in a motor vehicle headlight, it is possible to realize different lighting functions, such as, for example, ADB (Advanced Driving Beam), low-beam light, fog light and daylight running light, etc. In particular, the use of a plurality of semiconductor light sources and a plurality of optical waveguides whose light coupling-in surfaces are respectively assigned to the light-emitting surface of at least one of the semiconductor light sources enables a controllable variation of the light distribution of the light emitted by the lighting device according to various embodiments by means of individual semiconductor light sources being selectively switched on or off or their brightness or color being varied. The matrix-like arrangement of the light coupling-out surfaces of the optical waveguides allows a planar, matrix-like illumination by means of the lighting device according to various embodiments. Moreover, the fact that the light coupling-in surface of the optical waveguides is in each case smaller than the light-emitting surface of the at least one semiconductor light source assigned to said optical waveguide and the fact that light coupling-in surfaces belonging to different optical waveguides are arranged in different grating cells of the grating-like optical diaphragm ensure that light coupled into the respective optical waveguide is exclusively light which was emitted by the at least one semiconductor light source assigned to said optical waveguide. In addition, it is thereby ensured that the tolerance sensitivity of the lighting device according to various embodiments with regard to the relative positioning of the light coupling-in surfaces of the optical waveguides and the light-emitting surfaces of the semiconductor light sources is significantly reduced. The grating-like optical diaphragm improves the optical separation between neighboring optical waveguides. In particular, the grating-like optical diaphragm shades the light coupling-in surface of each optical waveguide from the light which is emitted by the semiconductor light sources assigned to the neighboring optical waveguides. Moreover, the grating-like optical diaphragm guides the optical waveguides into the desired position above the light exit surfaces of the semiconductor light sources during assembly. These measures make it possible to form a sharp bright-dark boundary between a region not illuminated and a region illuminated by means of the lighting device according to various embodiments in front of the motor vehicle. In various embodiments, it is thereby possible to realize the asymmetrical light distribution for the low-beam light with a sharply defined bright-dark boundary.

In various embodiments, the grating-like optical diaphragm of the lighting device according to various embodiments has blackened surfaces in order to avoid stray light and light reflection at the grating-like optical diaphragm.

The grating-like optical diaphragm of the lighting device according to various embodiments is advantageously designed as part of a mount for the optical waveguides, in order to improve the mechanical stability and the cohesion of the optical waveguides and in order to ensure an exact alignment of the light coupling-in surfaces of the optical waveguides with respect to the light-emitting surfaces of the semiconductor light sources even in the case of thermal expansion of the optical waveguides during the operation of the lighting device according to various embodiments.

In various embodiments, the optical waveguides of the lighting device according to various embodiments are connected to one another in the region of their light coupling-out surfaces, in order to further improve the mechanical stability and the cohesion of the optical waveguides and in order to fix the light coupling-out surfaces of the optical waveguides in their relative position and alignment even in the case of thermal expansion of the optical waveguides during operation of the lighting device according to various embodiments.

In various embodiments, the optical waveguides are connected to one another in the region of their light coupling-out surfaces for the abovementioned purpose by a common transparent cover. In addition to the mechanical stabilization of the optical waveguides, said transparent cover has the further advantage that it protects the light coupling-out surfaces of the optical waveguides against contamination and damage, without obstructing the light emission. Moreover, with the aid of the transparent cover it is possible to compensate for length differences in the case of the optical waveguides or projecting light coupling-out surfaces caused for example by light-emitting surfaces of the semiconductor light sources at different heights.

In various embodiments, the light coupling-out surfaces of neighboring optical waveguides are arranged alongside one another without gaps. This arrangement has the advantage that when the lighting device according to various embodiments is used in the headlight of a motor vehicle, grating-like shadows on the roadway in front of the motor vehicle are avoided.

In various embodiments, the light coupling-out surfaces of the optical waveguides of the lighting device according to various embodiments are in each case embodied in a quadrilateral or hexagonal fashion. The aforementioned shapes make it possible, in a simple manner, for the light coupling-out surfaces of the optical waveguides to be arranged in a positively locking manner without gaps. In accordance with various embodiments, the light coupling-out surfaces of the optical waveguides are embodied in a planar fashion in order to be able to position them in the focal plane of an optical lens. Alternatively, however, the light coupling-out surfaces of the optical waveguides can also be embodied in a curved fashion in order to be able to position them for example in the focal surface of a free-form reflector. The length of the optical waveguides can furthermore be individually different in order, for example, to compensate for height differences of the light-emitting surfaces of the semiconductor light sources.

In various embodiments, the optical waveguides of the lighting device according to various embodiments are in each case embodied in a conical fashion, such that the light coupling-in surface is arranged at a conically tapered end of the respective optical waveguide and the light coupling-out surface is arranged at a conically widened end of the respective optical waveguide. This makes it possible for the light coupling-out surfaces of the optical waveguides to be larger than their light coupling-in surfaces and for the lighting device according to various embodiments to have a correspondingly larger luminous area.

The optical waveguides of the lighting device according to various embodiments are advantageously designed in each case as a TIR optical unit. The abbreviation "TIR" in the term "TIR optical unit" stands for "Total Internal Reflection". The term "TIR optical unit" therefore denotes an optical unit whose function is based on the principle of total internal reflection, that is to say in which light rays impinge on the interface between the optically denser medium and the optically less dense medium at an angle of incidence greater than the critical angle of total reflection and are thus totally reflected at said interface, such that no transfer into the optically less dense medium takes place. The optically denser medium is the material of the optical waveguide, for example glass or transparent plastics material, and the optically less dense material is air or vacuum. In the case of an optical waveguide designed as a TIR optical unit, the light coupled into the optical waveguide can leave the optical waveguide only at its ends, since it is reflected at the lateral surface of the optical waveguide by means of total internal reflection. However, the TIR optical unit can also be embedded into materials containing a cooling medium, for example water or graphite or suitable thermally conductive nanotubes, for example carbon nanotubes, or said materials can flow around the TIR optical unit. Therefore, in various embodiments, the surface of the optical waveguides is embodied in a reflectively coated fashion outside the light coupling-in surface and the light coupling-out surface. This ensures that the light coupled into the respective optical waveguide is reflected at the reflectively coated surface and can leave the optical waveguide only at its light coupling-out surface or light coupling-in surface.

In various embodiments, the lighting device according to various embodiments is equipped with at least one optical lens which is disposed downstream of the light coupling-out surfaces of the optical waveguides with respect to the beam path of the light emitted by the semiconductor light sources. The light distribution generated by the semiconductor light sources and the optical waveguides can be imaged with the aid of the at least one optical lens. By way of example, in the case where the lighting device according to various embodiments is used in a motor vehicle headlight, the at least one optical lens makes it possible for the light distribution generated by the semiconductor light sources and the optical waveguides to be imaged into the region in front of the motor vehicle. For this purpose, the at least one optical lens is preferably designed and positioned in such a way that the light coupling-out surfaces of the optical waveguides are arranged in the focal plane of the at least one optical lens. The at least one optical lens therefore forms a so-called secondary optical unit and the optical waveguides form a so-called primary optical unit.

The lighting device according to various embodiments is preferably designed as part of a motor vehicle headlight in order to generate, with the aid of said lighting device, different light distributions, such as, for example, light distributions for ADB (Advanced Driving Beam), low-beam light, fog light, daytime running light, position light and dynamic cornering light.

Figure 2:
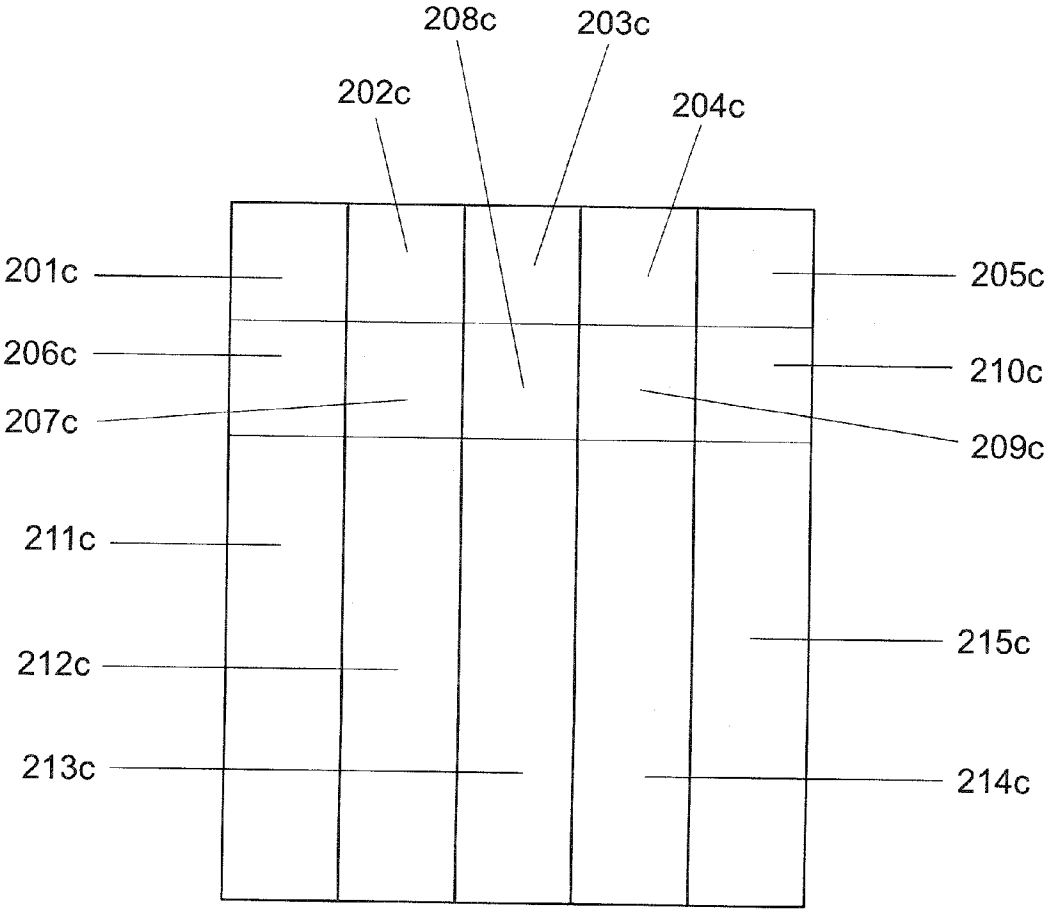
FIG. 2 shows a plan view of the light coupling-out surfaces of the optical waveguides of the lighting device depicted in FIG. 1.
Figure 3:
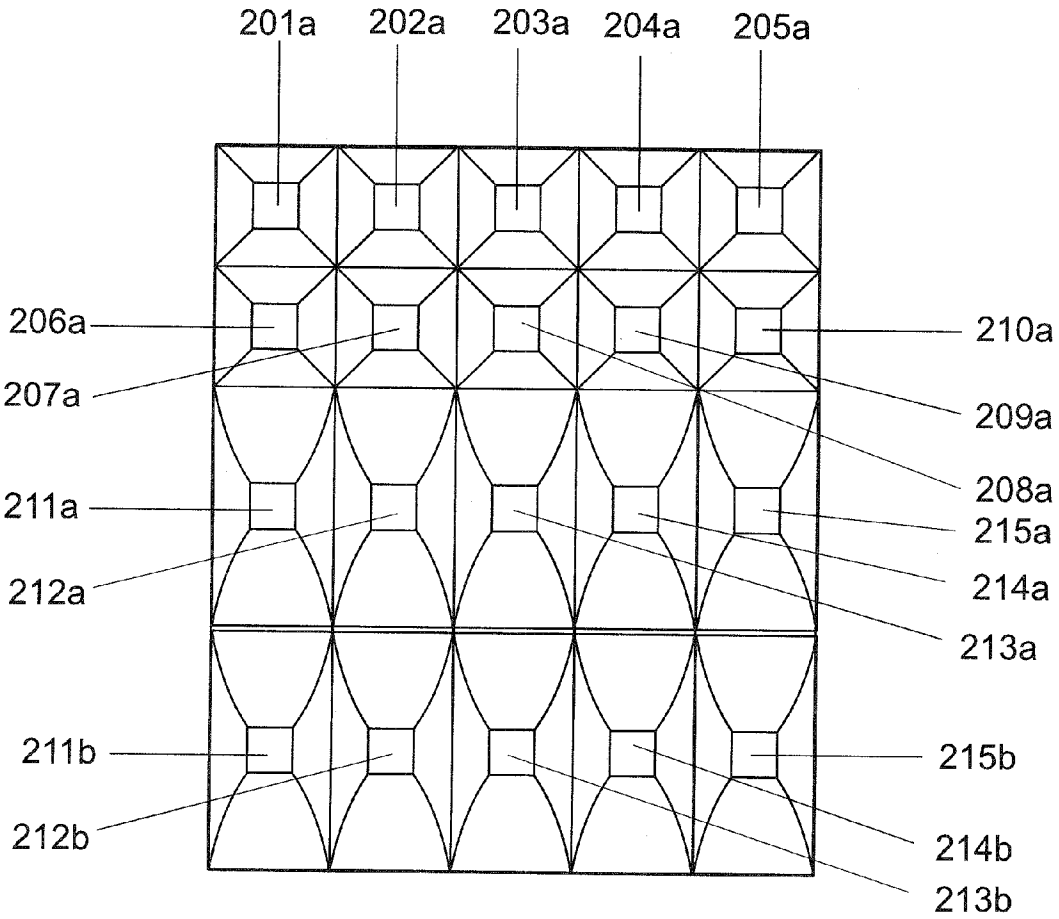
FIG. 3 shows a plan view of the light coupling-in surfaces of the optical waveguides depicted in FIG. 2.
Figure 4:
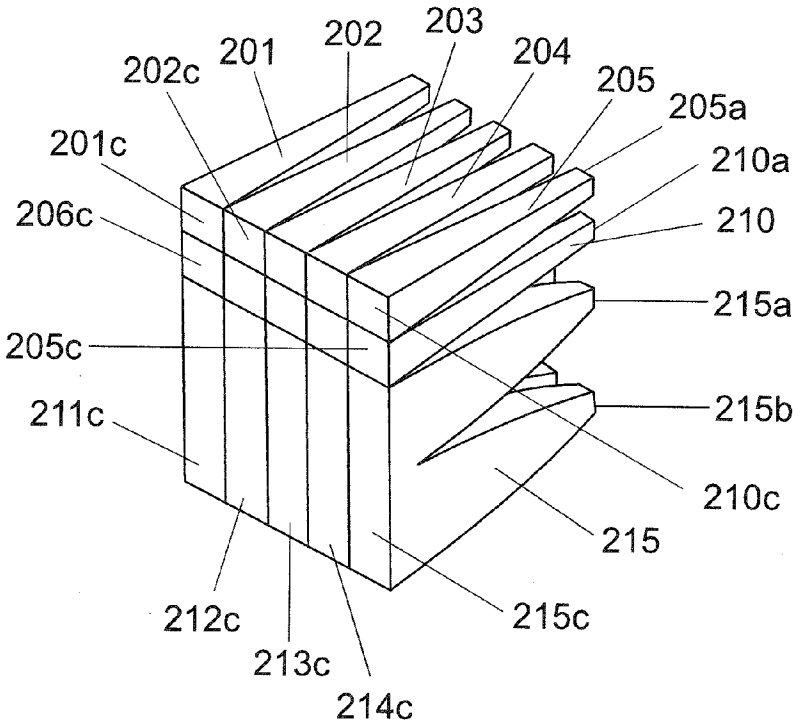
FIG. 4 shows a perspective view of the optical waveguides depicted in FIG. 2 and FIG. 3.
Figure 5:
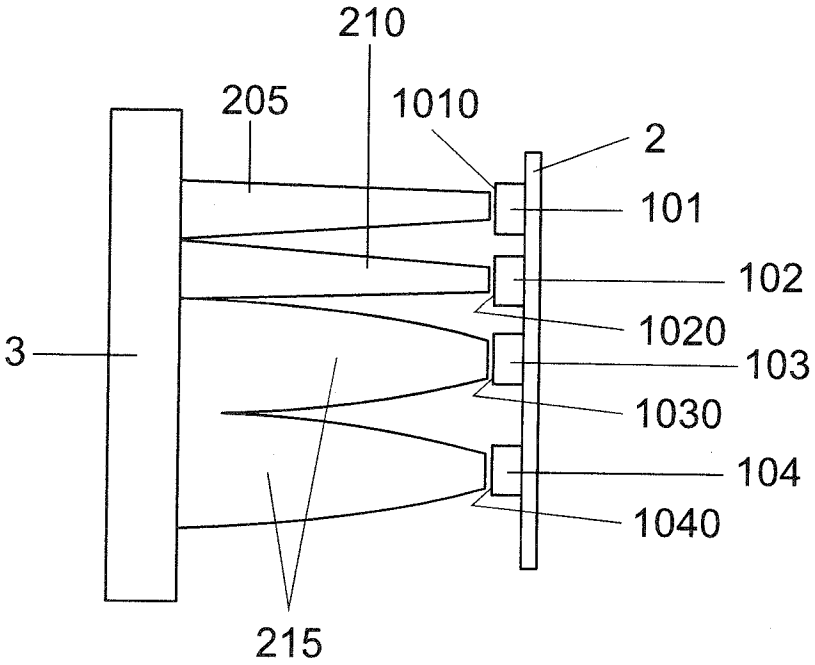
FIG. 5 shows a side view of the semiconductor light sources arranged on the common carrier, the optical waveguides and the transparent cover of the lighting device depicted in FIG. 1, in schematic illustration.
Figure 6:
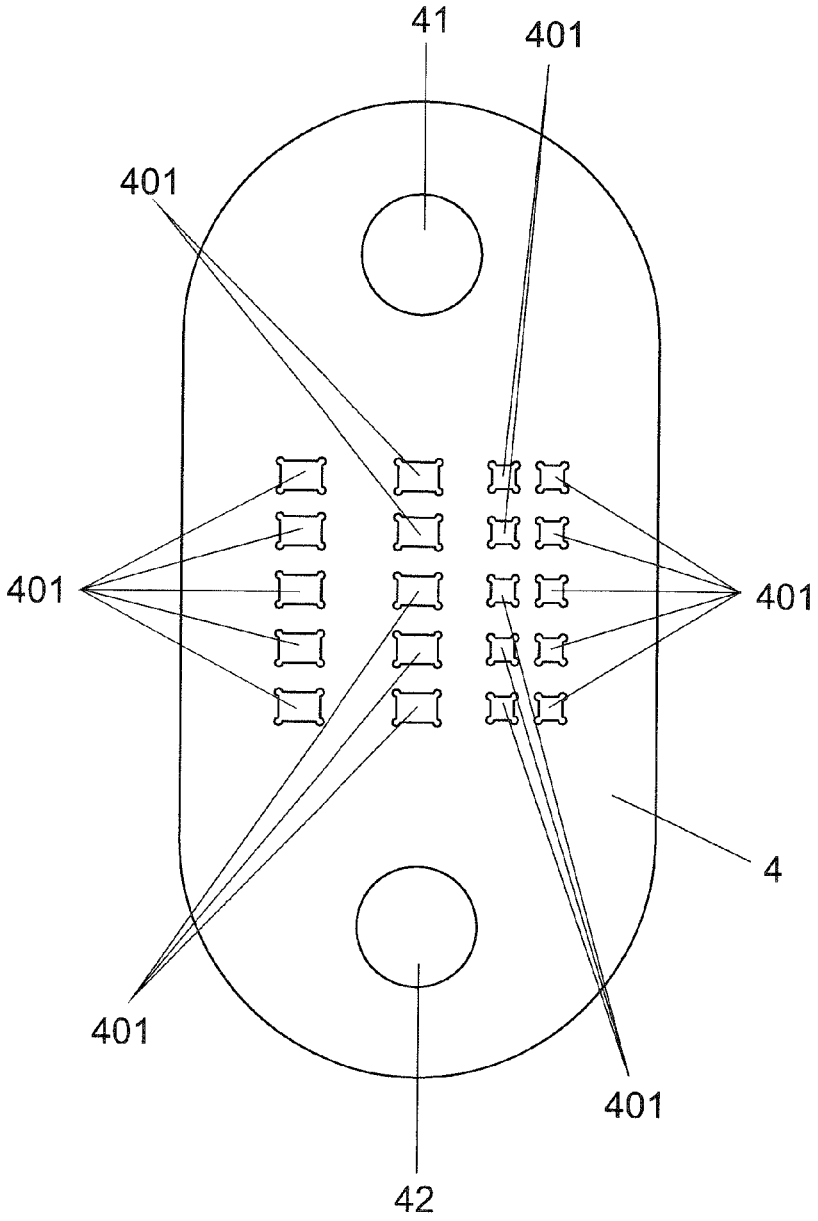
FIG. 6 shows a plan view of the grating-like optical diaphragm of the lighting device depicted in FIG. 1.

The lighting device in accordance with various embodiments has twenty semiconductor light sources 101, 102, 103, 104, fifteen optical waveguides 201, 202, 203, 204, 205, 210, 215 for the light emitted by the light-emitting diodes, a transparent cover 3 for the light coupling-out surfaces of the optical waveguides 201, 202, 203, 204, 205, 210, 215, a grating-like optical diaphragm 4 and an optical lens 5. The construction of this lighting device is illustrated schematically in FIG. 1. Only four of the total of twenty semiconductor light sources and only seven of the total of fifteen optical waveguides 201, 202, 203, 204, 205, 210, 215 are depicted in FIG. 1 to FIG. 6.

All twenty semiconductor light sources are designed as light-emitting diodes 101, 102, 103, 104, which are arranged in a matrix-like fashion in four lines and five rows on a common carrier 2. The light-emitting diodes 101, 102, 103, 104 emit white light during their operation. They can be driven individually or in groups by means of an operating circuit (not illustrated in the figures), such that the light-emitting diodes 101, 102, 103, 104 can be switched on and switched off separately from one another and the brightness of the light-emitting diodes 101, 102, 103, 104 can be regulated independently of one another. The light-emitting surface of each light-emitting diode 101, 102, 103, 104 has an area of 0.5625 $mm^2$.

The fifteen optical waveguides 201, 202, 203, 204, 205, 210, 215 have a total of twenty light coupling-in surfaces 201*a*, 202*a*, 203*a*, 204*a*, 205*a*, 206*a*, 207*a*, 208*a*, 209*a*, 209*b*, 210*a*, 211*a*, 211*b*, 212*a*, 212*b*, 213*a*, 213*b*, 214*a*, 214*b*, 215*a*, 215*b*, which are respectively assigned to one of the twenty light-emitting diodes 101, 102, 103, 104 and are arranged at a small distance from the light-emitting surface 1010, 1020, 1030, 1040 of the corresponding light-emitting diode 101, 102, 103, 104. Moreover, the fifteen optical waveguides 201, 202, 203, 204, 205, 210, 215 each have a planar light coupling-out surface 201*c*, 202*c*, 203*c*, 204*c*, 205*c*, 206*c*, 207*c*, 208*c*, 209*c*, 210*c*, 211*c*, 212*c*, 213*c*, 214*c*, 215*c*, from which the light coupled into the respective optical waveguide emerges again. The light coupling-out surfaces 201*c*, 202*c*, 203*c*, 204*c*, 205*c*, 206*c*, 207*c*, 208*c*, 209*c*, 210*c*, 211*c*, 212*c*, 213*c*, 214*c*, 215*c* of the optical waveguides are arranged alongside one another in three lines and five rows without gaps. That means that neighboring light coupling-out surfaces are arranged alongside one another without any spacing and the side edges of the light coupling-out surfaces are embodied as far as possible in a rectilinear and sharp-edged fashion, that is to say as far as possible without a rounding radius, such that any possible clearance between neighboring light coupling-out surfaces has a width of at most 50 micrometers. The light coupling-out surfaces 211*c*, 212*c*, 213*c*, 214*c*, 215*c* arranged in the third line each have a rectangular shape and an area of 2 mm times 10 mm corresponding to 20 $mm^2$. The optical waveguides 215 associated with said light coupling-out surfaces 211*c*, 212*c*, 213*c*, 214*c*, 215*c* each have two light coupling-in surfaces 211*a*, 211*b*, 212*a*, 212*b*, 213*a*, 213*b*, 214*a*, 214*b*, 215*a*, 215*b*, such that light from two light-emitting diodes 103, 104 is in each case coupled into said optical waveguides 215. The light coupling-out surfaces 201*c*, 202*c*, 203*c*, 204*c*, 205*c*, 206*c*, 207*c*, 208*c*, 209*c*, 210*c* arranged in the first and second lines each have a square shape and an area of 4 $mm^2$. All the light coupling-in surfaces 201*a*, 202*a*, 203*a*, 204*a*, 205*a*, 206*a*, 207*a*, 208*a*, 209*a*, 209*b* 210*a*, 211*a*, 211*b*, 212*a*, 212*b*, 213*a*, 213*b*, 214*a*, 214*b*, 215*a*, 215*b* each have a square shape having an area of 0.49 $mm^2$.

The optical waveguides 201, 202, 203, 204, 205, 210, 215 consist of a transparent, colorless plastics material, preferably composed of polycarbonate. Alternatively, however, other transparent, colorless plastics materials, such as polymethyl methacrylate (PMMA) or polymethyl methacrylimide PMMI, for example, can also be used. The optical waveguides 201, 202, 203, 204, 205, 210, 215 are designed in each case as a TIR optical unit, such that the light coupled into the respective optical waveguide 201, 202, 203, 204, 205, 210, 215 is reflected at its lateral surface on the basis of total internal reflection. The lateral surfaces of the optical waveguides 201, 202, 203, 204, 205, 210, 215, that is to say those regions of the outer surface of the optical waveguides 201, 202, 203, 204, 205, 210, 215 which lie outside the light coupling-in surface and light coupling-out surface, can additionally be embodied in a reflectively coated fashion by means of an aluminum coating. All the optical waveguides 201, 202, 203, 204, 205, 210, 215 are embodied in a conical fashion, such that their light coupling-in surfaces 201*a*, 202*a*, 203*a*, 204*a*, 205*a*, 206*a*, 207*a*, 208*a*, 209*a*, 209*b* 210*a*, 211*a*, 211*b*, 212*a*, 212*b*, 213*a*, 213*b*, 214*a*, 214*b*, 215*a*, 215*b* are arranged in each case at a tapered end of the respective optical waveguide 201, 202, 203, 204, 205, 210, 215 and their light coupling-out surfaces 201*c*, 202*c*, 203*c*, 204*c*, 205*c*, 206*c*, 207*c*, 208*c*, 209*c*, 210*c*, 211*c*, 212*c*, 213*c*, 214*c*, 215*c* are arranged at a widened end of the respective optical waveguide 201, 202, 203, 204, 205, 210, 215.

In the region of their light coupling-out surfaces 201*c*, 202*c*, 203*c*, 204*c*, 205*c*, 206*c*, 207*c*, 208*c*, 209*c*, 210*c*, 211*c*, 212*c*, 213*c*, 214*c*, 215*c*, the optical waveguides 201, 202, 203, 204, 205, 210, 215 are connected to one another by the transparent cover 3. The transparent cover 3 consists of transparent, colorless polycarbonate and is fused to the optical waveguides in the region of their light coupling-out surfaces by means of plastic injection-molding technology. The cover 3 serves for the mechanical support of the optical waveguides 201, 202, 203, 204, 205, 210, 215 and for stabilizing the positively locking connection of the light coupling-out surfaces 201*c*, 202*c*, 203*c*, 204*c*, 205*c*, 206*c*, 207*c*, 208*c*, 209*c*, 210*c*, 211*c*, 212*c*, 213*c*, 214*c*, 215*c* of the optical waveguides 201, 202, 203, 204, 205, 210, 215. Not all the light coupling-out surfaces are provided with their reference signs in FIG. 4, for the sake of better clarity.

The grating-like optical diaphragm 4 is situated in the region of the light coupling-in surfaces 201*a*, 202*a*, 203*a*, 204*a*, 205*a*, 206*a*, 207*a*, 208*a*, 209*a*, 209*b* 210*a*, 211*a*, 211*b*, 212*a*, 212*b*, 213*a*, 213*b*, 214*a*, 214*b*, 215*a*, 215*b* of the optical waveguides 201, 202, 203, 204, 205, 210, 215. Said grating-like optical diaphragm is embodied and positioned in such a way that all the light coupling-in surfaces 201*a*, 202*a*, 203*a*, 204*a*, 205*a*, 206*a*, 207*a*, 208*a*, 209*a*, 209*b* 210*a*, 211*a*, 211*b*, 212*a*, 212*b*, 213*a*, 213*b*, 214*a*, 214*b*, 215*a*, 215*b* are arranged in each case in a separate grating cell 401 of the grating-like optical diaphragm 4. The optical diaphragm 4 shades the light coupling-in surfaces 201*a*, 202*a*, 203*a*, 204*a*, 205*a*, 206*a*, 207*a*, 208*a*, 209*a*, 209*b* 210*a*, 211*a*, 211*b*, 212*a*, 212*b*, 213*a*, 213*b*, 214*a*, 214*b*, 215*a*, 215*b* relative to one another, such that only light from one of the twenty light-emitting diodes 101, 102, 103, 104 is coupled into each light coupling-in surface 201*a*, 202*a*, 203*a*, 204*a*, 205*a*, 206*a*, 207*a*, 208*a*, 209*a*, 209*b* 210*a*, 211*a*, 211*b*, 212*a*, 212*b*, 213*a*, 213*b*, 214*a*, 214*b*, 215*a*, 215*b*. In addition, the optical diaphragm 4 also serves as a mount for the optical waveguides and for mechanically stabilizing the optical waveguides 201, 202, 203, 204, 205, 210, 215 in the region of their light coupling-in surfaces 201*a*, 202*a*, 203*a*, 204*a*, 205*a*, 206*a*, 207*a*, 208*a*, 209*a*, 209*b* 210*a*, 211*a*, 211*b*, 212*a*, 212*b*, 213*a*, 213*b*, 214*a*, 214*b*, 215*a*, 215*b*. The grating-like optical diaphragm 4 consists of high-grade steel sheet or aluminum sheet or of plastic and has two perforations 41, 42 for screws for fixing it to the carrier 2. The surfaces of the grating-like optical diaphragm 4 are anodized black. The grating-like optical diaphragm 4 is arranged at a distance of 0.1 mm from the light-emitting surfaces 1010, 1020, 1030, 1040 of the light-emitting diodes 101, 102, 103, 104.

The optical lens 5 of the lighting device in accordance with various embodiments is designed as a planoconvex optical lens having a focal length of 100 mm. In various embodiments, the optical lens 5 is embodied as a chromatically corrected doublet produced from glasses or transparent colorless plastics having different refractive indices. The optical lens 5 is disposed downstream of the optical waveguides 201, 202, 203, 204, 205, 210, 215 with respect to the beam path of the light emitted by the light-emitting diodes 101, 102, 103, 104, that is to say that the light emitted by the light-emitting diodes 101, 102, 103, 104 firstly impinges on the optical waveguides 201, 202, 203, 204, 205, 210, 215 before it reaches the optical lens 5. The light coupling-out surfaces 201*c*, 202*c*, 203*c*, 204*c*, 205*c*, 206*c*, 207*c*, 208*c*, 209*c*, 210*c*, 211*c*, 212*c*, 213*c*, 214*c*, 215*c* of the optical waveguides 201, 202, 203, 204, 205, 210, 215 are arranged in the focal plane of the optical lens 5.

With the aid of the optical lens 5, the light distribution generated by the light-emitting diodes 101, 102, 103, 104 and optical waveguides 201, 202, 203, 204, 205, 210, 215 is imaged onto the road in front of the motor vehicle. In order to vary the light distribution, individual or a plurality of the twenty light-emitting diodes 101, 102, 103, 104 are selectively switched on or off or the brightness or color thereof is regulated.

The lighting device in accordance with various embodiments is provided as part of a motor vehicle headlight. In order to generate the light distributions for the functions ADB, low-beam light, fog light, daytime running light, position light and parking light, one or a plurality of such lighting devices can be arranged in the motor vehicle headlight.

Various embodiments are not restricted to the embodiment explained in greater detail above. By way of example, the number and also the arrangement of the light-emitting diodes and accordingly of the optical waveguides can be varied. Instead of or in addition to inorganic light-emitting diodes, e.g. on the basis of InGaN or AlInGaP, generally organic LEDs (OLEDs, e.g. polymer OLEDs) can also be used. Moreover, instead of light-emitting diodes, it is also possible to use other types of semiconductor light sources, such as, for example, laser diodes with or without a phosphor for the wavelength conversion of the laser excitation light. Furthermore, the lighting device according to various embodiments can additionally also include semiconductor light sources which emit colored light, in various embodiments orange-colored light, in order to be able additionally to realize the function of direction indicators for example in the front region of the vehicle.

While the invention has been particularly shown and described with reference to specific embodiments, it should be understood by those skilled in the art that various changes in form and detail may be made therein without departing from the spirit and scope of the invention as defined by the appended claims. The scope of the invention is thus indicated by the appended claims and all changes which come within the meaning and range of equivalency of the claims are therefore intended to be embraced.

What is claimed is:

1. A lighting device, comprising:

a plurality of semiconductor light sources; and a plurality of optical waveguides;

wherein the optical waveguides each have at least one light coupling-in surface and a light coupling-out surface;

wherein the light coupling-in surfaces of the optical waveguides are respectively assigned a light-emitting surface of at least one semiconductor light source, such that light emitted by the light-emitting surface of the at least one semiconductor light source impinges on the light coupling-in surface of the optical waveguide assigned thereto;

wherein the light coupling-out surfaces of the optical waveguides are arranged in the form of a matrix;

wherein the light coupling-in surface of the respective optical waveguide is smaller than the light-emitting surface of the at least one semiconductor light source assigned to said optical waveguide, and an optical diaphragm embodied as a grating having grating cells is provided, which is arranged in the region of the light coupling-in surfaces of the optical waveguides, such that light coupling-in surfaces belonging to different optical waveguides are arranged in different grating cells of the optical diaphragm embodied as a grating.

2. The lighting device of claim 1, wherein the optical diaphragm embodied as a grating has blackened surfaces.

3. The lighting device of claim 1, wherein the optical diaphragm embodied as a grating is designed as part of a mount for the optical waveguides.

4. The lighting device of claim 1, wherein the optical waveguides are connected to one another in the region of their light coupling-out surfaces.

5. The lighting device of claim 4, wherein the optical waveguides are connected to one another in the region of their light coupling-out surfaces by a common transparent cover.

6. The lighting device of claim 1, wherein the light coupling-out surfaces of neighboring optical waveguides are arranged alongside one another without gaps.

7. The lighting device of claim 1, wherein the light coupling-out surfaces of the optical waveguides are embodied in a quadrilateral or hexagonal fashion.

8. The lighting device of claim 1, wherein the optical waveguides are embodied in a conical fashion, such that the light coupling-in surface is arranged at a conically tapered end of the optical waveguide and the light coupling-out surface is arranged at a conically widened end of the optical waveguide.

9. The lighting device of claim 1, wherein the optical waveguides are designed as Total Internal Reflection optical units.

10. The lighting device of claim 1, wherein the surface of the optical waveguides is embodied in a reflectively coated fashion outside the light coupling-in surface and the light coupling-out surface.

11. The lighting device of claim 1, wherein the lighting device comprises at least one optical lens which is disposed downstream of the light coupling-out surfaces of the optical waveguides with respect to the beam path of the light emitted by the semiconductor light sources.

12. The lighting device of claim 1, wherein the lighting device is designed as part of a vehicle headlight.

13. A lighting device, comprising:

a plurality of light sources; and a plurality of optical waveguides;

wherein the optical waveguides each have at least one light coupling-in surface and a light coupling-out surface;

wherein the light coupling-in surfaces of the optical waveguides are respectively arranged relative to a light-emitting surface of at least one light source, such that light emitted by the light-emitting surface of the at least one light source enters the optical waveguide via the light coupling-in surface assigned thereto;

wherein the light coupling-out surfaces of the optical waveguides are arranged in the form of a matrix;

wherein the light coupling-in surface of the respective optical waveguide is smaller than the light-emitting surface of the at least one semiconductor light source assigned to said optical waveguide, and a an optical diaphragm embodied as a grating having grating cells is provided, which is arranged in the region of the light coupling-in surfaces of the optical waveguides, such that light coupling-in surfaces belonging to different optical waveguides are arranged in different grating cells of the optical diaphragm embodied as a grating.

* * * * *